United States Patent [19]

Arendt

[11] 4,049,052

[45] Sept. 20, 1977

[54] SUBSURFACE ANNULUS SAFETY VALVE

[75] Inventor: Henry P. Arendt, Dallas, Tex.

[73] Assignee: Otis Engineering Corporation, Dallas, Tex.

[21] Appl. No.: 673,928

[22] Filed: Apr. 5, 1976

[51] Int. Cl.[2] ..... E21B 23/00; E21B 43/12

[52] U.S. Cl. ..... 166/183; 166/321; 166/322

[58] Field of Search ..... 166/129, 183, 188, 224 A, 166/321, 322

[56] References Cited

U.S. PATENT DOCUMENTS

| | | | |
|---|---|---|---|
| 3,045,755 | 7/1962 | Page et al. | 166/129 |
| 3,035,642 | 8/1957 | Page | 166/224 A |
| 3,156,300 | 11/1964 | Page et al. | 166/72 |
| 3,186,483 | 6/1965 | Schwab | 166/183 |
| 3,252,476 | 4/1963 | Page, Jr. | 166/224 A |
| 3,299,955 | 1/1967 | Page, Jr. | 166/129 |
| 3,313,350 | 4/1967 | Page, Jr. | 166/72 |

*Primary Examiner*—James A. Leppink
*Attorney, Agent, or Firm*—Vinson & Elkins

[57] ABSTRACT

Disclosed is a safety system to control flow within a well which includes an annulus safety valve to control flow in the annulus between concentric well pipe and which may include a tubing safety valve to control flow in the inner pipe.

17 Claims, 6 Drawing Figures

SUBSURFACE ANNULUS SAFETY VALVE

BACKGROUND OF THE INVENTION

A. Field of the Invention

The safety system of this invention is usable to control flow of fluids in a well wherein the well environment may include high pressure conditions, such as 20,000 psi gas pressures; high corrosive fluids, such as $H_2S$ or $CO_2$; and/or high temperatures, all of which are detrimental to resilient seals.

B. The Prior Art

The combination of a tubing safety valve and an annulus safety valve to control flow of fluids within a well is disclosed by U.S. Pat. No. 3,035,642 to J. S. Page; U.S. Pat. No. 3,313,350 to J. S. Page, Jr.; and U.S. Pat. No. 3,252,476 to J. S. Page, Jr. Annulus safety valves for controlling flow in the annulus between concentric well pipe are disclosed by U.S. Pat. Nos. 3,045,755; 3,156,300; both to Page, et al and U.S. Pat. No. 3,299,955 to J. S. Page, Jr.

Some of the aforementioned safety valves have been commercialized as illustrated on pages 4115 through 4117 of the "COMPOSITE CATALOGUE OF OIL FIELD EQUIPMENT & SERVICES", 1974–1975 edition.

The present annulus safety valves in combination with tubing safety valves, provide controlled flow through concentric well pipes. However, in the high temperature, high corrosive, and/or high pressure environment of some wells, these annulus safety valves are insufficient.

The valve member of the aforementioned U.S. Pat. Nos. 3,035,642; 3,253,476; and 3,156,300; and the valve member illustrated in the "COMPOSITE CATALOGUE" is moved in response to pressurizing a pressure chamber. The resilient seals of the pressure chamber are exposed to the well environment even after the valve member closes the annulus flow path. The high corrosive, and/or high temperature well environment could deteriorate these resilient seals and high pressure well fluids could blowout through the pressure chamber.

All of the aforementioned annulus safety valves utilize a sleeve valve member with resilient seals to block the annulus flow. The resilient seals may deteriorate and leak. It is not economically feasible to obtain a metal to metal seal with a sleeve valve member because expansions and contractions due to temperature variations cannot be accommodated and because sand collects around the sleeve valve member and inhibits a good metal to metal seal. Also, with a sleeve valve, the higher the fluid pressure of the fluid contained by the valve, the greater the tendency of the valve to leak.

The aforementioned annulus valves, except for the U.S. Pat. No. 3,035,642, disclose utilizing a valve member which closes the annulus flow path at a position other than at its upstream end. Additionally the valve housing is not integral. Therefore, potential leak paths from the annulus flow path through the valve housing exist. Even though the valve member closes the annulus flow path, the safety valve could fail to perform its function of shutting in the well due to a leakage through one of these potential leak paths.

The aforementioned annulus valves, except for the U.S. Pat. No. 3,035,642, all have a tortuous annulus flow path. High velocity flow of well fluids through these tortuous flow paths cause flow cutting of valve components and/or the surrounding well pipe.

The aforementioned U.S. Pat. No. 3,035,642 has a metal to resilient seal between a sleeve valve member and a resilient packer. The resilient seat could deteriorate in a high corrosive well environment preventing a good seal with the sleeve valve member.

Problems with the aforementioned annulus safety valves can be summarized as follows: Valve components, including the operating means for the valve member, are subject to downhole well fluids even though the valve member is in a position closing the annulus flow path. There is more than one seal location, and thus additional structures to seal, even though the valve member is in a flow path closing position. The greater the well pressure the greater the likelihood that the valve will fail due to leakage past the sleeve valve member. The resilient seals may deteriorate and/or prove ineffective in some well environments. Additionally the tortuous flow path through the valve member results in flow cutting of either the valve member or the surrounding well pipe.

OBJECTS OF THE INVENTION

An object of this invention is to provide a surface controlled subsurface annulus safety valve wherein the control chamber and its seals are isolated from upstream well fluids or pressure when the valve is in a closed position.

Another object of this invention is to provide a surface controlled subsurface annulus safety valve in which the operating piston is protected against a large pressure differential when the valve is closed.

Another object of this invention is to provide a surface controlled subsurface annulus safety valve with only one sealing location among the valve housing and valve member components.

Another object of this invention is to provide a surface controlled subsurface annulus safety valve wherein, when the valve is closed, the greater the downhole well pressure, the more effective the seal provided by the valve.

Another object of this invention is to provide a surface controlled subsurface annulus safety valve having a substantially straight through flow path to eliminate flow cutting and having a control chamber whose seals are isolated from upstream well fluids or pressure when the valve is closed.

Another object of this invention is to provide a surface controlled subsurface annulus safety valve having a control chamber whose seals are disposed out of the fluid flow path through the valve to minimize the likelihood of control chamber seal failure due to erosion or deterioration.

Another object of this invention is to provide a surface controlled subsurface safety system for controlling flow in concentric well pipes including a tubing safety valve to control flow in the inner pipe and an annulus safety valve to accomplish any of the aforementioned objects, the safety system including a single control conduit to control the operation of both valves.

These and other objects, and features of advantage, of the present invention will be apparent from the drawings, the detailed description, and the appended claims.

BRIEF DESCRIPTION OF THE DRAWINGS

In the drawings wherein like numerals indicate like parts and an illustrative embodiment of this invention is shown.

DESCRIPTION OF THE PREFERRED EMBODIMENT

Figure 1:
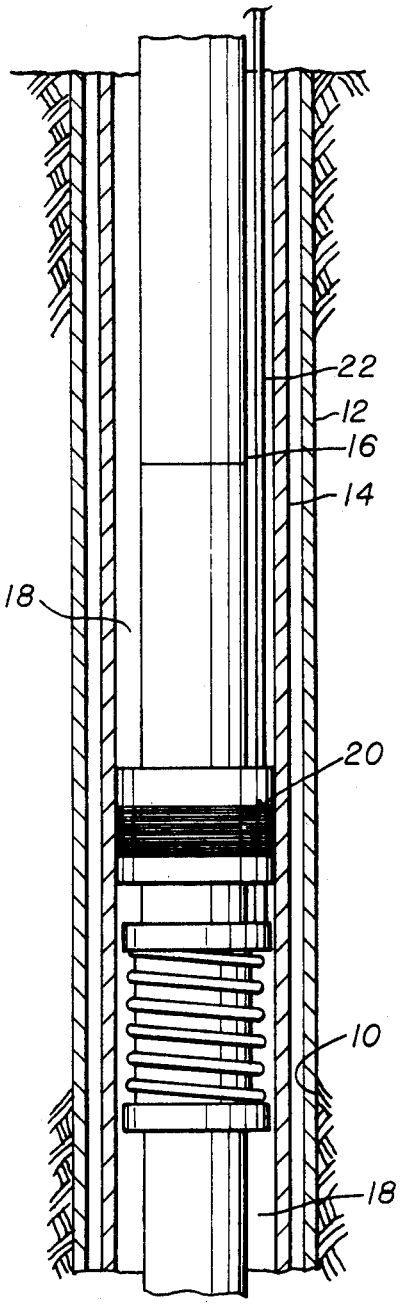
FIG. 1 is a schematic illustration of a well utilizing the subsurface system of this invention.

Referring to FIG. 1, when the well 10 is drilled, one or more well pipes, such as casing strings 12 and 14 are positioned within the well 10 to line or case the well wall. Through the casing strings 12 and 14 extends another well pipe 16 which may be a production tubing or test string.

For various reasons it may be desirous to control the flow of well fluids in both the bore of the inner pipe 16 and the annulus 18 between the inner pipe 16 and the casing string 14. For example with dual zone production, production fluids from one zone may flow in the bore of the inner pipe 16 while production fluids from a second zone may flow in the annulus 18. Another possibility would be to have production fluids flow through the bore of the inner pipe 16 while gas is injected down the annulus 18 for gas lift recovery or while inhibitors are injected down the annulus 18.

To control the flow of well fluids in the annulus 18 an annulus safety valve 20 may be provided. Because of the environmental conditions encountered in some wells, there are certain desirable features for an annulus safety valve 20. The annulus safety valve 20 should have a high pressure rating on the order of 20,000 psi. The closed valve 20 should seal against high pressure well fluids even at high temperatures and even though the well fluids are highly corrosive. When the valve 20 is open, it should provide a relatively straight, non-tortuous, baffle-free flow path to minimize flow cutting of valve parts and the surrounding well pipe. Preferably, the valve 20 is controlled from the surface, and the control system should be arranged so that the valve is not accidentally or unintentionally opened. As illustrated in FIG. 1, control conduit means 22 extends from the surface to the valve 20 to control the valve 20. Through control conduit means 22 hydraulic control fluid may be pumped to pressurize a chamber to in turn open the annulus safety valve 20.

To control the flow of well fluids in the bore or the inner pipe 16 a tubing safety valve may be provided. The tubing safety valve is controlled by fluid pressure transmitted to it through conduit means extending from the surface to the tubing safety valve. The tubing safety valve control conduit may be a separate conduit. However, to simplify the controls of the subsurface safety system, both the annulus safety valve 20 and the tubing safety valve are controlled by pressurized fluid conducted to them through conduit means 22.

The annulus valve includes mandrel means 24 forming a portion of the inner pipe, passage means 26 through mandrel means 24, valve member means 28 to control flow through passage means 26, and means for operating the valve member means 28.

Mandrel means 24 is adapted to be connected in the inner pipe 16. It is tubular and has a bore 30 therethrough through which well fluids may flow.

To seal off the annulus 18 between tubular mandrel means 24 and casing string 14, packer means 32 extend circumferentially around mandrel means 24. Packer means 32 may take any desired form and is adapted when set, to seal with the inner wall of 34 of casing string 14.

To provide a flow path for fluids in the annulus 18 by-passing packer means 32, passage means 26 are provided through mandrel means 24.

To provide a substantially straight annulus flow path through mandrel means 24, mandrel means 24 preferably includes outer flange means 36. Packer means 32 extend circumferentially around outer flange means 36 and passage means 26 by-passing packer means 32 extend axially through flange means 36.

Figure 4:
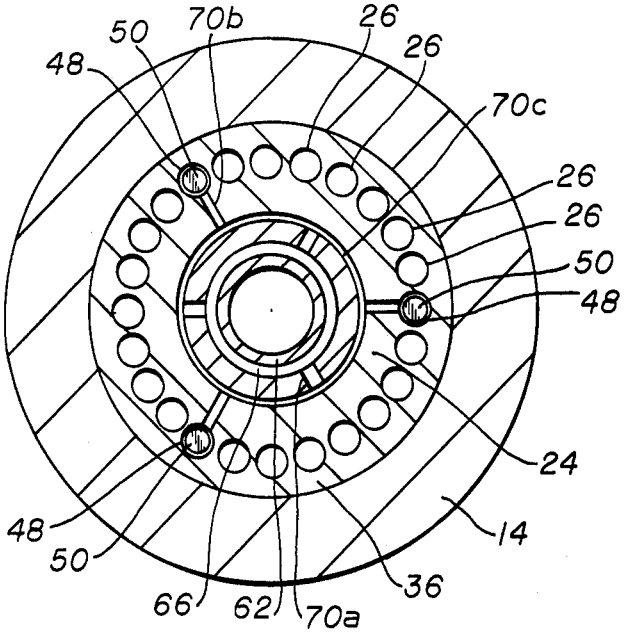
FIG. 4 is a view in cross-section taken along line 4—4 of FIG. 2B.
Figure 5:
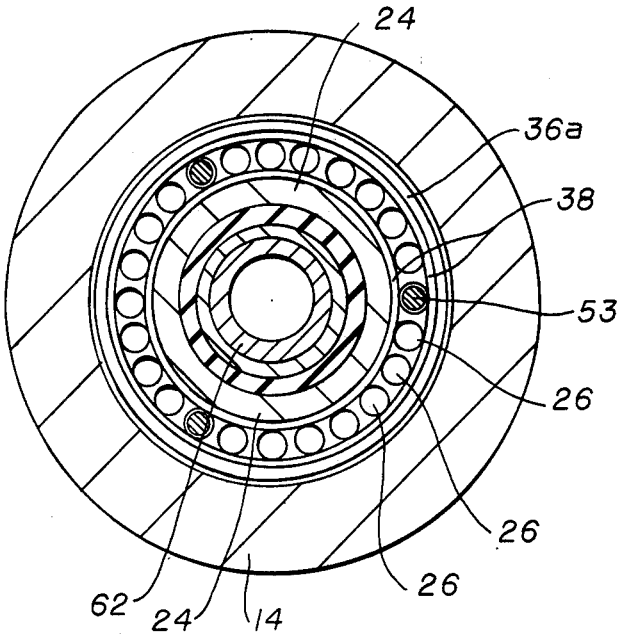
FIG. 5 is a view in cross-section taken along line 5—5 of FIG. 2B.

To increase the flow area of passage means 26 through flange means 36, passage means 26 may include a plurality of circumferentially spaced passageway means extending longitudinally through flange means 36 as seen in FIGS. 4 and 5.

With this arrangement of mandrel means 24, including flange means 36 through which extend passage means 26, an integral housing is provided for the annulus safety valve. Therefore only one main seal, packer means 32, exists, in addition to the seal provided by the valve itself.

To provide a portion of the valve seal, valve seat means 38 on mandrel means 24 is associated with passage means 26. Preferably, valve seat means 38 is located at the upstream end of passage means 26 so that when it is engaged by valve member means 28, the means for operating the valve member means 28, including the operating piston, the pressure chamber and their respective seals, are protected from the downhole well environment and isolated from the upstream well pressure. If passage means 26 includes the plurality of passageway means extending through flange means 36, then, valve seat means 38 may comprise an annular valve seat means on the lower surface **36*a* of flange means 36**.

Valve member means 28 controls the flow of well fluids through passage means 26. Valve member means 28 is axially movable on mandrel means 24 between a position wherein its valve head means 40 sealingly engages valve seat means 38 to block flow through passage means 26 and a position spaced from valve seat means 38 to permit flow through passage means 26.

Preferably, a metal to metal seal is provided by the engagement of valve head means 40 with valve seat means 38. Thus, the valve seat means 38 may be an abutment valve seat means with valve head means 40 being a metal abutment valve head means.

If valve seat means 38 comprises an annular valve seat means, then valve member means 28 would comprise an annular valve member means surrounding mandrel means 24.

To provide for a fail-safe, normally-closed annulus safety valve, means are provided for biasing valve member means 28 to a position engaging valve seat means 38. Preferably, spring biasing means 42 is provided to positively bias valve member means 28 to a position engaging valve seat means 38. A spring biasing means 42 would be relatively unaffected by an adverse downhole well environment. The illustrated spring biasing means 42 is shown positioned between a shoulder 44 of valve member means 28 and collar means 46 surrounding mandrel means 24.

Means are provided to move valve member means 28 to a position remote from valve seat means 38 to open passage means 26 to fluid flow by-passing packer means 32. A portion of this moving means comprises chamber means 48 including pressure responsive means 50 adapted to move valve member means 28 when chamber means 48 is pressurized.

Preferably chamber means 48 is protected from the downhole well environment, which may comprise high pressure, highly corrosive well fluids, and high temperatures, when valve member means 28 engages valve seat means 38. To protect chamber means 48 when the annulus safety valve is closed, chamber means 48 is located downstream of valve seat means 38; e.g., a chamber means 48 is located on the side of valve seat means 38 opposite valve member means 28.

Figure 2A:
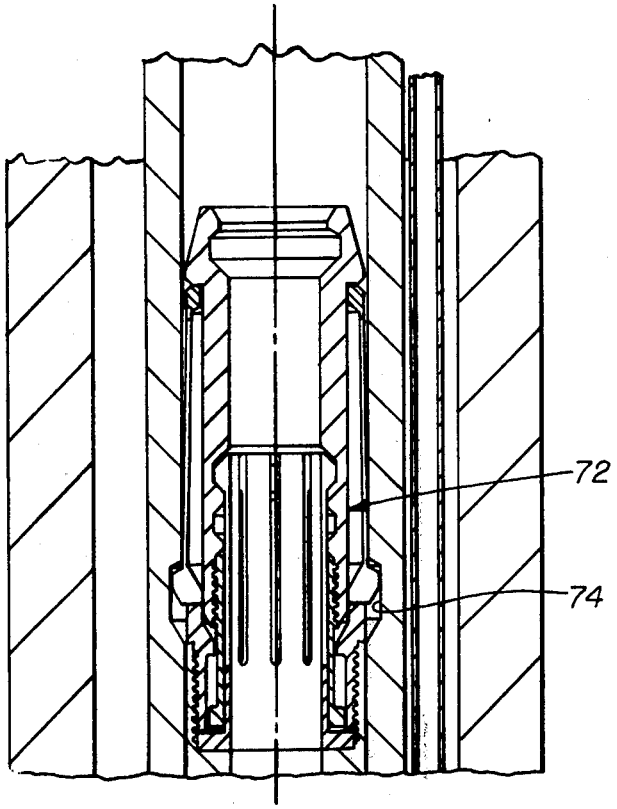
FIGS. 2A and 2B are continuation views in cross-section of a subsurface safety system according to this invention with the valves in open position.

The illustrated chamber means 48 is formed by utilizing a portion of at least one passageway (See FIGS. 4 and 5) downstream from valve seat means 38 (See FIGS. 2 and 3) with pressure responsive means 50 disposed in chamber means 48. Pressure responsive means 50 includes piston head means **50*a* having seal 52 around it to seal with the wall of chamber means 48. Piston head means 50*a* is adapted to slide axially within chamber means 48 in response to sufficient pressurizing or depressurizing of chamber means 48.**

To move valve member means 28 when chamber means 48 is pressurized, rod means 53 depends from piston head means **50*a* and is attached to valve member means 28.**

Figure 2B:
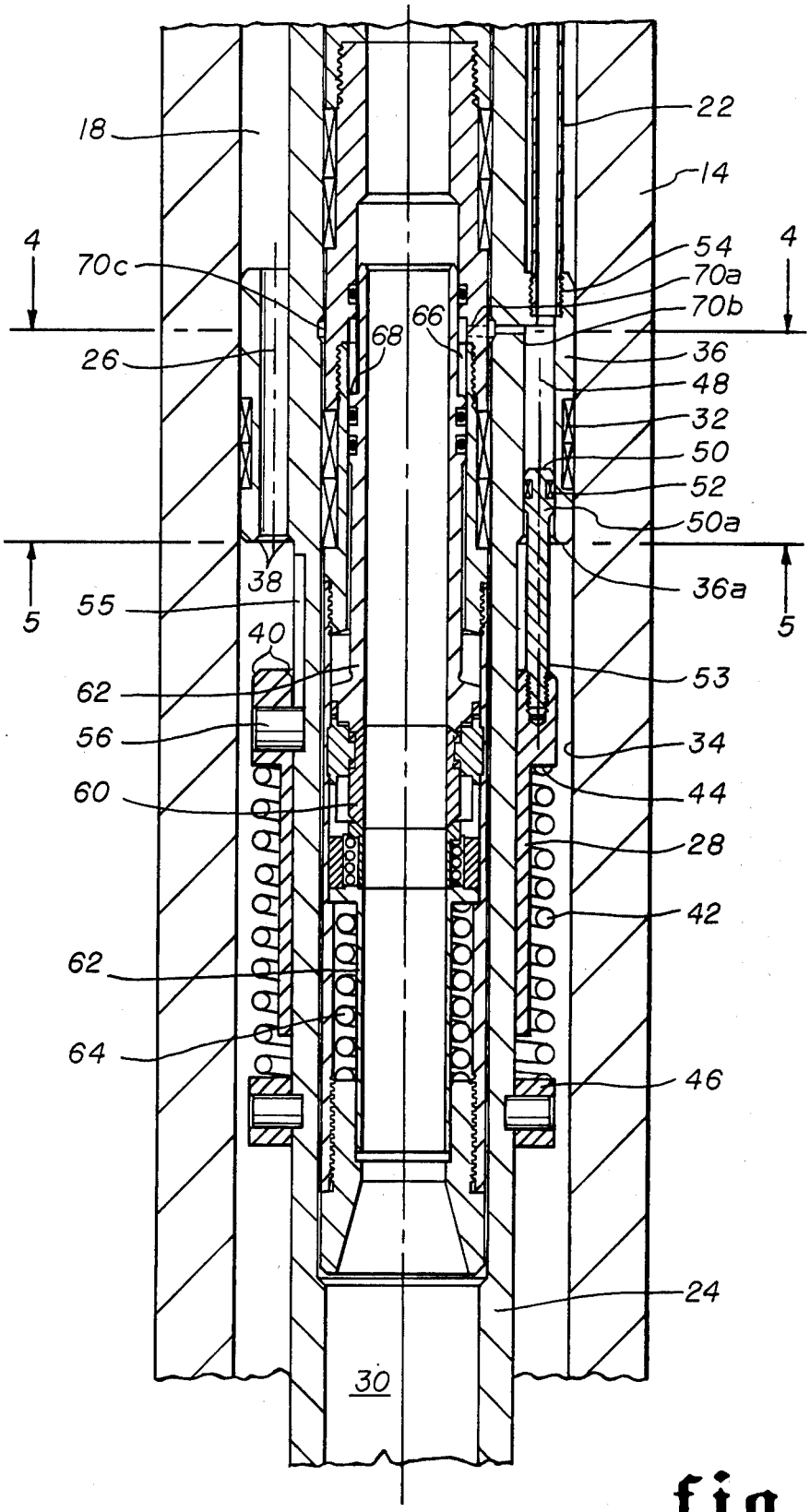
Figure 3:
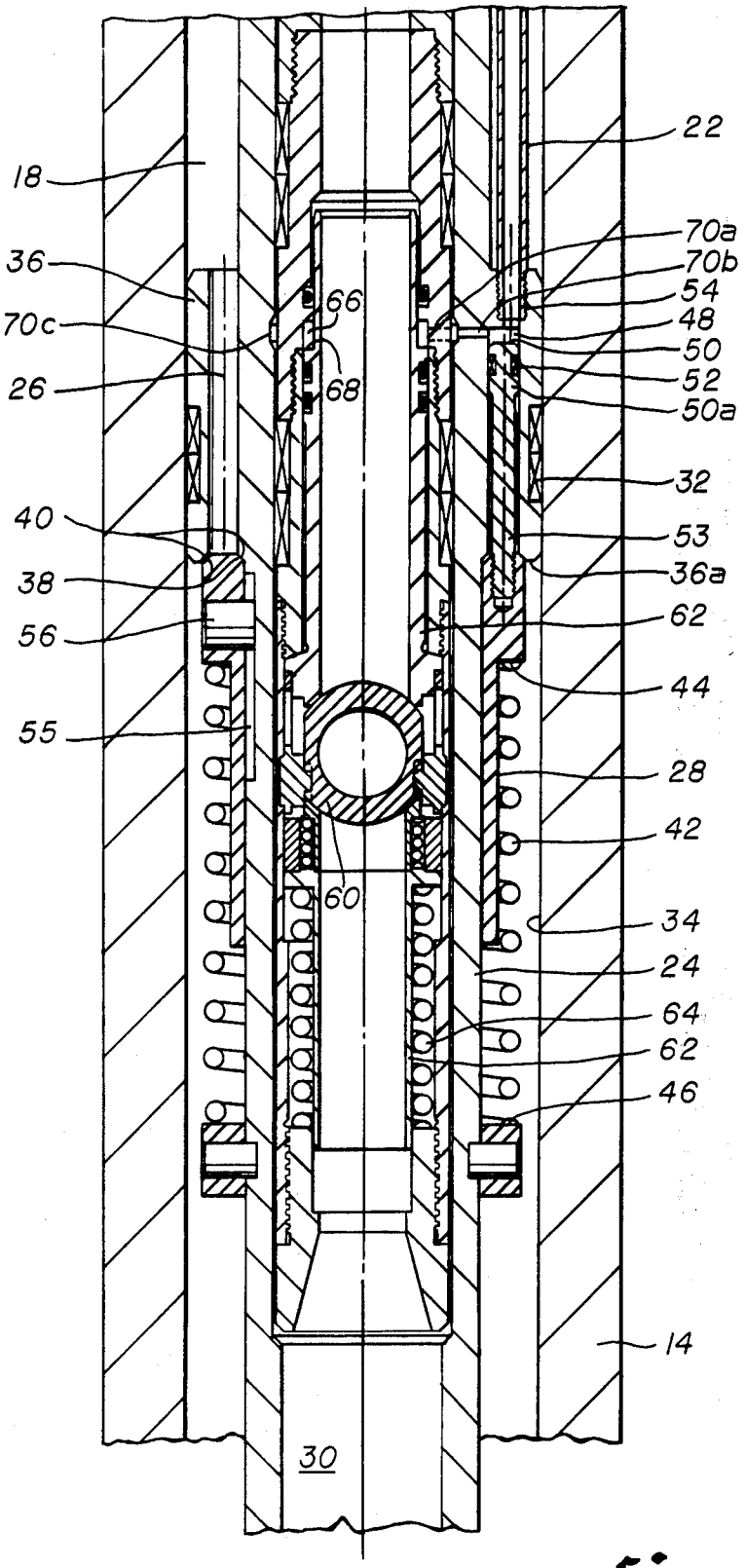
FIG. 3 is a view in cross-section of the subsurface safety system of FIG. 2B with the valves in closed position.

When chamber means 48 is sufficiently pressurized, pressure responsive means 50 will move to the position illustrated in FIG. 2B with valve member means 28 remote from valve seat means 38. When chamber means 48 is depressurized, spring biasing means 42 will move valve member means 28 to a position engaging valve seat means 38 as shown in FIG. 3.

Means are provided to pressurize chamber means 48. Port means 54 communicates with chamber means 48 and is adapted to be connected to conduit means 22 extending from the surface. Pressurized hydraulic control fluid is pumped through conduit means 22 to chamber means 48 to control the annulus safety valve.

Means are provided to prevent rotation of the annular valve member means 28 about the mandrel means 24. The anti-rotation means may be axial slot means 55 along mandrel means 24 engaged by pin means 56 carried by valve member means 28.

To control fluid flow in the bore 30 of tubular mandrel means 24, a tubing safety valve is provided. The tubing safety valve may be any conventional tubing safety valve. However, in a harmful well environment, the tubing safety valve should provide a metal to metal seal to effectively close the bore 30 to the flow of well fluids and should protect the piston chamber means from the influence of downhole well fluids or pressure when the tubing safety valve is closed.

The illustrated tubing safety valve is a wireline retrievable tubing safety valve although other types could be used.

The tubing safety valve includes a valve member means 60 to control flow through the bore 30 and means for operating the valve member means.

Valve member means 60 is movable between a position opening the bore 30 (See FIG. 2B) and a position closing the bore 30 (See FIG. 3).

Valve member operator means 62 moves the valve member means 60 and is itself movable between a first position wherein valve member means 60 opens the bore 30 (see FIG. 2B) and a second position wherein valve member means 60 closes the bore 30 (see FIG. 3).

The means for moving valve member operator means 62 include means 64 for biasing valve member operator means 62 to its second position and a controlled means for moving the valve member operator means 62 to its first position.

The control means, including piston chamber means 66 and piston means 68, is adapted to move valve member operator means 62 to its first position when piston chamber means 66 is sufficiently pressurized.

Hydraulic control fluid is injected into piston chamber means 66 to pressurize it.

The hydraulic controls of the illustrated safety system are simplified by including single conduit means 22 extending from the surface to the valves to transmit control fluid to both chamber means 48 and piston chamber means 66. Communicating means are provided between piston chamber means 66 and chamber means 48. The illustrated communicating means 70 includes port means **70*a* in the tubing safety valve housing in communication with piston chamber means 66, port means 70*b* in tubular mandrel means 24 in communication with chamber means 48, and annular groove means 70*c* in tubular mandrel means 24 in communication with both port means 70*a* and 70*b*. Although port means 54, which is connected to conduit means 22, communicates with chamber means 48, it could communicate with any one of chamber means 48, piston chamber means 66, or communicating means 70.**

Means are provided to lock the retrievable tubing safety valve within recess means of tubular mandrel means 24. Any means may be provided which locks the tubing safety valve within tubular mandrel means 24 against upward movement. Due to the high formation pressures which may be encountered and which will act upwardly through the inner well pipe against the tubing safety valve, the releasable locking means must be able to withstand a considerable pressure differential across the tubing safety valve.

The illustrated releasable locking means (FIG. 2A) generally indicated at 72 is of a type which locks when it enters a suitable recess 74. The releasable locking means 72 may be unlocked and the tubing safety valve retrieved from the tubular mandrel means 24 by an appropriate fishing tool (not shown).

In operation, the safety system of this invention includes an annulus subsurface safety valve and may include a tubing subsurface safety valve when it is desired to control flow in both the tubing bore and the annulus between concentric well pipes. The inner well pipe 16 is run with tubular mandrel means 24 and other associated parts of the annulus safety valve assembled thereon. A tubing safety valve may be installed in the bore of the inner well pipe 16.

To open the valves and permit fluid flow, conduit means 22 is pressurized. The hydraulic control fluid from conduit means 22 pressurizes chamber means 48 of the annulus subsurface safety valve and piston chamber means 66 of the tubing safety valve. Pressure responsive means 50 moves the annulus safety valve member means 28 to a position remote from valve seat means 38 to open passage means 26 to fluid flow in the annulus 18 by-passing packer means 32. Likewise piston means 68 moves valve member operator means 62 to its first position with the tubing safety valve member means 60 opening the bore 30 to fluid flow.

When it is desired to stop the flow of fluid in the well, control conduit means 22 is depressurized. Spring biasing means 42 of the annulus safety valve provides an upward acting force against annulus valve member means 28 to overcome the hydrostatic head of fluid within conduit means 22 acting downwardly upon the pressure responsive means 50. The upward acting force of spring biasing means 42, assisted by downhole well pressure, moves valve member means 28 to a position engaging valve seat means 38 to close the annulus flow path. Likewise, biasing means 64 of the tubing safety valve provides an upward acting force on valve member operator means 62 to overcome the hydrostatic head of force acting downwardly on piston means 68. The valve member operator means 62 is moved to its second position and valve member means 60 is moved to a bore 30 closing position.

If desired, the relative biasing forces of spring biasing means 42 of the annulus safety valve and of biasing means 64 of the tubing safety valve may be varied so that either valve may close first or so that both valves may close substantially simultaneously.

With the illustrated construction of the annulus safety valve, once the annulus safety valve is closed a slight unintentional rise of pressure in control conduit means 22 above that of the downhole well pressure will not open the annulus safety valve. This is because the area of piston head means 50*a* is small compared with the area sealed by the annulus valve member means 28. Thus, pressure sufficiently in excess of downhole well pressure must be exerted on pressure responsive means 50 to move valve member means 28 to a position remote from valve seat means 38. Pressure sufficiently above that of the downhole well pressure would only be introduced in conduit means 22 intentionally. Slight increases in pressure in conduit means 22, which may happen unintentionally, would not open the annulus safety valve.

Likewise, once the tubing safety valve is closed, it will not open in response to ordinary pressures in conduit means 22. This is because the area of piston means 68 is also small compaired with the area sealed by valve member means 60. The difference in areas means that a sufficiently high pressure, in excess of downhole well pressure, would have to be transmitted to piston chamber means 66 to move valve member means 60 to a position opening the bore 30. It is not likely that such a high pressure would ever be applied unintentionally.

From the foregoing it may be seen that an improved subsurface safety valve system has been provided. The subsurface safety valve system controls flow through concentric well pipe and includes an annulus safety valve and may include a tubing safety valve.

The annulus safety valve provides abutment, metal to metal sealing of valve member means with valve seat means. This seating insures an adequate seal in a high pressure, high corrosive, and high temperature well environment.

Additionally, when the annulus safety valve is closed, the higher the downhole pressure, the more effective the seal provided by the valve.

The annulus safety valve has an integral, single component housing. Therefore when the valve is closed, fluids upstream in the annulus are confined by one main packer seal and the valve seating seal. Other potential leak paths are nonexistent.

The valve seating location is at the upstream end of the annulus flow path through the annulus safety valve thereby protecting the deteriative and pressure sensitive components of the annulus safety valve from the downhole well fluids when the valve member seats against the valve seat. In particular, the chamber and control conduit are protected from the downhole well fluids and a high pressure differential.

The annulus flow path through the annulus safety valve is straight to eliminate flow cutting.

The tubing safety valve is usable with the annulus safety valve and also provides a metal to metal seal and protects the piston chamber when the valve is closed.

The hydraulic controls for the safety system are simplified by including a single control conduit through which fluid is pumped to control both the annulus safety valve and the tubing safety valve.

The foregoing disclosure and description of the invention are illustrative and explantory thereof and various changes in the size, shape of materials, as well as in the details of the illustrated construction may be made within the scope of the appended claims without departing from the spirit of the invention.

What is claimed is:

1. An annulus subsurface safety valve for controlling flow in the annulus between concentric well pipes comprising:

mandrel means adapted to be connected in the inner pipe;

packer means extending circumferentially about said mandrel means and adapted to seal with the outer pipe;

passage means by-passing said packer means through said mandrel means;

valve seat means on said mandrel means at the lower end of said passage means;

valve member means axially movable on said mandrel means between a position engaging said valve seat means thereby closing said passage means and a position spaced from said valve seat means thereby opening said passage means and located exterior of said mandrel means upstream from said valve seat means;

means for biasing said valve member means to a position engaging said valve seat means;

chamber means, including pressure responsive means forming a portion of said chamber means;

said pressure responsive means being adapted to move said valve member means to a position spaced from said valve seat means when said chamber means is pressurized; and said chamber means being located downstream from said valve seat means in a position to be protected from well fluids in the annulus when said valve member means engages said valve seat means.

2. The annulus safety valve of claim 1 wherein:

said valve seat means comprises an annular valve seat means; and said valve member means comprises an annular valve member means surrounding said mandrel means.

3. The annulus safety valve of claim 1 including:
port means communicating with said chamber means adapted to be connected to conduit means extending to the surface.

4. The annulus safety valve of claim 1 including:
conduit means extending from the surface to the safety valve; and
port means communicating with said chamber means adapted to be connected to said conduit means.

5. An annulus subsurface safety valve for controlling flow in the annulus between concentric well pipes comprising:
mandrel means adapted to be connected in the inner pipe;
outer flange means forming a portion of said mandrel means;
packer means extending circumferentially about said outer flange means and adapted to seal with the outer pipe;
passage means by-passing said packer means through said mandrel means and including a plurality of circumferentially spaced passageway means extending longitudinally through said flange means;
valve seat means on said mandrel means at the lower end of said passage means;
valve member means axially movable on said mandrel means between a position engaging said valve seat means thereby closing said passage means and a position spaced from said valve seat means thereby opening said passage means;
means for biasing said valve member means to a position engaging said valve seat means;
chamber means, including pressure responsive means forming a portion of said chamber means;
said pressure responsive means being adapted to move said valve member means to a position spaced from said valve seat means when said chamber means is pressurized; and
said chamber means being located downstream from said valve seat means in a position to be protected from well fluids in the annulus when said valve member means engages said valve seat means.

6. The annulus safety valve of claim 5 wherein:
said chamber means comprises at least one passageway means extending logitudinally through said flange means with said pressure responsive means including piston head means axially slidable within said passageway means; and
rod means depends from said piston head means and is attached to said valve member means.

7. An annulus subsurface safety valve for controlling flow in the annulus between concentric wells comprising:
mandrel means adapted to be connected in the inner pipe;
packer means extending circumferentially about said mandrel means and adapted to seal with the outer pipe;
passage means by-passing said packer means through said mandrel means;
valve seat means on said mandrel means at the lower end of said passage means and comprising an annular valve seat means;
valve member means axially movable on said mandrel means between a position engaging said valve seat means thereby closing said passage means and a position spaced from said valve seat means thereby opening said passage means and comprising an annular valve member means and surrounding said mandrel means;
means for biasing said valve member means to a position engaging said valve seat means;
chamber means, including pressure responsive means forming a portion of said chamber means;
said pressure responsive means being adapted to move said valve member means to a position spaced from said valve seat means when said chamber means is pressurized;
said chamber means being located downstream from said valve seat means in a position to be protected from well fluids in the annulus when said valve member means engages said valve seat means;
axial slot means in the surface of one of said mandrel means and said valve member means; and
pin means carried by the other of said mandrel means and said valve member means and engaging said slot means.

8. An annulus and tubing safety system for use in concentric well pipes comprising:
tubular mandrel means to be connected in an inner pipe;
annulus safety valve means including:
outer flange means on said tubular mandrel means,
seal means extending circumferentially about said outer flange means and adapted to seal with the outer pipe,
passage means through said flange means,
valve seat means on said flange means at one end of said passage means,
first valve member means axially moveable on said tubular mandrel means between a position engaging said valve seat means and a position spaced from said valve seat means and located exterior of said tubular mandrel means upstream from said valve seat means,
means for biasing said first valve member means onto said valve seat means,
chamber means including pressure responsive means forming a portion of said chamber means,
said pressure responsive means adapted to move said first valve member means to a position opening said passage means when said chamber means is pressurized, and
said chamber means being located downstream from said valve seat means in a position to be protected from well fluids in the annulus when said first valve member means engages said valve seat;
tubing safety valve means including:
second valve member means adapted for movement between positions opening and closing the bore of said tubular mandrel means;
valve member operator means to move said second valve member means to a position opening the bore,
means for biasing said valve member operator means to a position wherein said second valve member means is in a bore closing position, and
piston chamber means including piston means,
said piston means being carried by said valve member operator means and adapted to move said valve member operator means to a position wherein said second valve member means opens the bore when said piston chamber means is pressurized;

communicating means between said piston chamber means and said chamber means; and port means communicating with one of said chamber means, piston chamber means and communicating means and adapted for attachment to conduit means extending to the surface.

9. The safety system of claim 8 wherein said passage means includes:

a plurality of circumferentially spaced passageway means extending longitudinally through said flange means.

10. The safety system of claim 8 wherein:

said valve seat means comprises an annular valve seat; and said valve member means comprises an annular valve member surroundng said mandrel means.

11. An annulus and tubing safety system for use in concentric well pipes comprising:

tubular mandrel means adapted to be connected in an inner pipe;

annulus safety valve means including:

outer flange means on said tubular mandrel means, seal means extending circumferentially about said outer flange means and adapted to seal with the outer pipe, passage means through said flange means, valve seat means on said flange means at one end of said passage means, first valve member means axially moveable on said tubular mandrel means between a position engaging said valve seat means and a position spaced from said valve seat means, means for biasing said first valve member means onto said valve seat means, chamber means including pressure responsive means forming a portion of said chamber means, said pressure responsive means being adapted to move said first valve member means to a position opening said passage means when said chamber means is pressurized, said chamber means being located downstream from said valve seat means in a position to be protected from well fluids in the annulus when said first valve member means engages said valve seat, said chamber means comprising at least one passageway means extending longitudinally through said flange means with said pressure responsive means including piston head means axially slidable within said passageway means, and rod means depends from said piston head means and is attached to said valve member means;

tubing safety valve means including:

second valve member means adapted for movement between positions opening and closing the bore of said tubular mandrel means, valve member operator means to move said second valve member means to a position opening the bore, means for biasing said valve member operator means to a position wherein said second valve member means is in a bore closing position, and piston chamber means including piston means, said piston means being carried by said valve member operator means and adapted to move said valve member operator means to a position wherein said second valve member means opens the bore when said piston chamber member is pressurized;

communicating means between said piston chamber means and said chamber means; and port means communicating with one of said chamber means, piston chamber means and communicating means and adapted for attachment to conduit means extending to the surface.

12. An annulus and tubing safety system for use in concentric well pipes comprising:

tubular mandrel means adapted to be connected in an inner pipe;

annulus safety valve means including:

outer flange means on said tubular mandrel means, seal means extending circumferentially about said outer flange means and adapted to seal with the outer pipe, passage means through said flange means, valve seat means on said flange means at one end of said passage means, first valve member means axially moveable on said tubular mandrel means between a position engaging said valve seat means and a position spaced from said valve seat means, means for biasing said first valve member means onto said valve seat means, chamber means including pressure responsive means forming a portion of said chamber means, said pressure responsive means being adapted to move said first valve member means to a position opening said passage means when said chamber means is pressurized, and said chamber means being located downstream from said valve seat means in a position to be protected from well fluids in the annulus when said first valve member means engages said valve seat;

tubing safety valve means including:

second valve member means adapted for movement between positions opening and closing the bore of said tubular mandrel means, valve member operator means to move said second valve member means to a position opening the bore, means for biasing said valve member operator means to a position wherein said second valve member means is in a bore closing position, and piston chamber means including piston means, said piston means being carried by said valve member operator means and adapted to move said valve member operator means to a position wherein said second valve member means opens the bore when said piston chamber means is pressurized;

communicating means between said piston chamber means and said chamber means;

port means communicating with one of said chamber means, piston chamber means and communicating means and adapted for attachment to conduit means extending to the surface;

axial slot means in the surface of one of said tubular mandrel means and said first valve member means; and pin means carried by the other of said tubular mandrel means and said first valve member means and engaging said slot means.

13. An annulus subsurface safety valve for controlling flow in the annulus between concentric well pipes comprising:

mandrel means adapted to be connected in an inner pipe;

packer means extending circumferentially about said mandrel means and adapted to seal with the outer pipe;

passage means by-passing said packer means through said mandrel means;

abutment metal-to-metal valve seat means at one end of said passage means on said mandrel means;

valve member means axially moveable on said mandrel means;

said valve member means including abutment metal-to-metal valve head means adapted for metal-to-metal sealing engagement with said valve seat means;

means for biasing said valve member means to a position wherein said valve head means engages said valve seat means;

chamber means, including pressure responsive means forming a portion of said chamber means;

said pressure responsive means being adapted to move said valve member means to a position wherein said valve head means is spaced from said valve seat means when said chamber means is pressurized.

14. The annulus safety valve of claim 13 including:

outer flange means forming a portion of said mandrel means;

wherein said packer means extends about said outer flange means; and wherein said passage means includes:

a plurality of circumferentially spaced passageway means extending longitudinally through said flange means.

15. The annulus safety valve of claim 13 wherein:

said abutment valve seat comprises an annular abutment valve seat means; and said abutment valve head means comprises an annular abutment valve head means.

16. An annulus subsurface safety valve for controlling flow in the annulus between concentric well pipes comprising:

mandrel means adapted to be connected in an inner pipe;

outer flange means forming a portion of said mandrel means;

packer means extending circumferentially about said outer flange means and adapted to seal with the outer pipe;

passage means by-passing said packer means through said mandrel means and including a plurality of circumferentially spaced passageway means extending longitudinally through said flange means;

abutment valve seat means at one end of said passage means on said mandrel means;

valve member means axially moveable on said mandrel means;

said valve means includingg abutment valve head means adapted to engage said abutment valve seat means;

means for biasing said valve member means to a position wherein said abutment valve head means engages said abutment valve seat means;

chamber means, including pressure responsive means forming a portion of said chamber means;

said pressure responsive means being adapted to move said valve member means to a position wherein said abutment valve head means is spaced from said abutment valve seat means when said chamber means is pressurized;

said chamber means comprising at least one passageway means extending longitudinally through said flange means with said pressure responsive means including piston head means axially slidable within said passageway means; and rod means depends from said piston head means and is attached to said valve member means.

17. An annulus subsurface safety valve for controlling flow in the annulus between concentric well pipes comprising:

mandrel means adapted to be connected in the inner pipe;

outer flange means included on said mandrel means;

packer means extending circumferentially about said outer flange means and adapted to seal with the outer pipe;

circumferentially spaced passageway means by-passing said packer means and extending longitudinally through said flange means;

annular, abutment valve seat means on said flange means at the upstream end of said passageway means;

valve member means axially movable on said mandrel means;

said valve member means including annular, abutment valve head means adapted to engage said annular, abutment valve seat means;

means for biasing said valve member means to a position wherein said valve head means engages said valve seat means;

chamber means comprising the downstream portion at least one of said passageway means and a pressure responsive means;

said pressure responsive means including piston head means movable axially within said chamber means;

rod means extending from said piston head means to said valve member means;

with said piston head means and rod means adapted to move said valve head means of said valve member means to a position spaced from said valve seat means when said chamber means is pressurized; and port means communicating with said chamber means adapted to be connected to conduit means.

* * * * *

UNITED STATES PATENT AND TRADEMARK OFFICE

CERTIFICATE OF CORRECTION

PATENT NO. : 4,049,052

DATED : September 20, 1977

INVENTOR(S) : Henry P. Arendt

It is certified that error appears in the above-identified patent and that said Letters Patent are hereby corrected as shown below:

Column 3, line 7 - after the word "subsurface" insert -- safety --.

Column 7, line 52 - delete "compaired" and insert therefore -- compared --.

Column 8, line 11 - delete "deteriative" and insert therefore -- deteriorative --.

Claim 7, line 2 - delete "wells" and insert therefore -- well pipes --.

Claim 16, line 19 - before the word "means" insert -- member -- and delete "includingg" and insert therefore -- including --.

Signed and Sealed this

Sixth Day of June 1978

[SEAL]

*Attest:*

RUTH C. MASON
*Attesting Officer*

DONALD W. BANNER
*Commissioner of Patents and Trademarks*